United States Patent [19]

Coyne

[11] 4,195,889

[45] Apr. 1, 1980

[54] CAMPER BOX

[76] Inventor: Robert P. Coyne, 854 Martindale Rd., Sudbury, Ontario, Canada, P3E 4H8

[21] Appl. No.: 859,093

[22] Filed: Jan. 31, 1978

[30] Foreign Application Priority Data

Nov. 17, 1977 [CA] Canada ..... 291102

[51] Int. Cl.[2] ..... A47B 85/00

[52] U.S. Cl. ..... 312/240; 312/241; 312/DIG. 33; 190/12 R; 248/461

[58] Field of Search ..... 312/241, 231, 244, 240, 312/237, DIG. 33; 248/461; 190/11, 12 R; 126/9 R, 37 R, 37 B

[56] References Cited

U.S. PATENT DOCUMENTS

| | | | |
|---|---|---|---|
| 873,855 | 12/1907 | Goldin | 190/11 |
| 2,213,985 | 9/1940 | Howe | 190/11 |
| 2,411,332 | 11/1946 | Orchard | 190/12 R |
| 2,460,958 | 2/1949 | Williams | 190/12 R |
| 2,575,537 | 11/1951 | Trumfio | 312/244 |
| 2,603,500 | 7/1952 | Messier | 190/12 R |
| 2,662,989 | 12/1953 | Thatcher | 190/12 R |
| 3,010,551 | 11/1961 | Weeks | 190/12 R |
| 3,031,247 | 4/1962 | Schieve | 248/461 |
| 3,543,890 | 12/1970 | Criswell | 190/12 R |
| 3,915,529 | 10/1975 | Bernier | 312/237 |

FOREIGN PATENT DOCUMENTS

| | | | |
|---|---|---|---|
| 1150281 | 1/1958 | France | 312/DIG. 33 |
| 178956 | 4/1962 | Sweden | 312/DIG. 33 |

*Primary Examiner*—Victor N. Sakran

[57] ABSTRACT

This invention relates to a compact, portable camping box designed to hold the necessary equipment for the preparation and serving of meals and which is readily convertible at the site of use to provide a table or work surface. It consists basically of an open-sided box having top, bottom, and end members and includes interhinged leaves attached to the sides of the box so that when folded upwardly the leaves serve as side members for the box in addition to providing an enclosed storage space for the component parts of a three-legged tubular support frame.

4 Claims, 8 Drawing Figures

CAMPER BOX

FIELD OF THE INVENTION

It is not uncommon to arrive at a favourite campground and find that there are no picnic tables or benches available or on occasion to camp in an isolated area where no such conveniences are provided. As campers well know it is not only a great convenience to have the necessary equipment for meal preparation compactly stored but the whole procedure of preparing meals is made much less burdensome if one is equipped with an elevated work surface or table.

It is therefore the primary object of this invention to provide a box-table combination which folds into a compact, easily portable receptacle designed to provide enclosed storage space for a support means, a gas stove, wash basin, utensils, cutlery etc., and in use unfolds to provide an elevated box mounted on tubular framing and having horizontal work surfaces extending from both sides.

It is also an object of this invention to provide a box-table combination which is lightweight, strong, simple in construction and inexpensive to manufacture.

It is a further object of this invention to provide a box-table combination which includes a three-legged tubular supporting frame having one telescopic leg which permits rapid and easy leveling of the table surface.

DESCRIPTION OF THE PRIOR ART

A search of Canadian patents related to camper boxes failed to reveal any inventions having the features of the present invention.

The following U.S. patents were considered, but in my opinion, none of them satisfy the three basic requirements of simplicity, economy, and trouble-free operation.

U.S. Pat. Nos. 2,411,332, 1946 Orchard Cl. 190/12; 2,460,958, 1949 Williams 190/12; 3,010,551, 1961 Weeks 190/12; 3,543,890, 1970 Criswell 190/12; 3,915,529, 1975 Bernier 312/237.

All of the above-mentioned inventions show four-legged support means which can complicate the leveling of the table surface.

Orchard's patent makes use of triangular-shaped hinged braces which by their bulk use up valuable storage space and require extra manipulative steps in setting up. The legs when stored take up space within the main body of the box. When the removable top is in place the box space above the drawers is not easily accessible.

The patent to Williams shows the same undesirable feature, more particularly, a center table top panel provided with a finger-hole recess to permit removal when entry to the box is necessary. Furthermore, the legs are pivoted to swing in a single plane along the length of the box so that when the table leaves are extended at right angles to that plane and subjected to any appreciable weight a tipping action will occur.

The patent to Weeks shows a rather complicated arrangement of interhinged parts with strap-like braces which when mounted on the scissors-type frame may not provide complete stability. The scissors-type frame must be stored separately, a feature which could result in its being damaged and in any case adding another item to the camper's packing list.

Criswell's patent shows a neatly arranged interhinged leaf system but provides a very limited expanse of work surface. The back of the box is permanently closed by means of a rigidly fixed panel. Four telescopic legs are provided each having rod members which captively retain the sliding inner tubular leg members to prevent their loss, with spring urged detent members to latch the sliding leg members in their retracted positions. These additional elements and mechanisms could add substantially to the cost of manufacture.

Bernier's patent shows an elaborate and sophisticated portable field kitchen sufficiently complex in structure to make it too expensive for the average camper.

DESCRIPTION OF THE PREFERRED EMBODIMENTS

Figure 1:
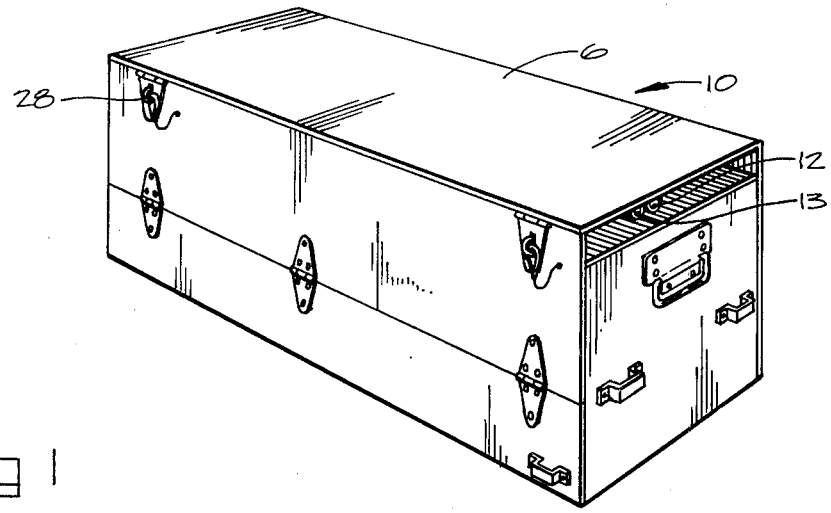
FIG. 1 is a perspective view of the device when folded up for storage or transport.

Referring now to the drawings, FIG. 1 shows the box-table combination 10 folded up and ready for transport or storage. The device may be constructed of any suitable lightweight, durable material, preferably fiberglass. Hinged leaf 6 when folded up over the top of the box provides a space above the top of the box for the storage of the tubular frame members, two of which are indicated by numerals 12 and 13. Hinged leaf 6 when folded over in that position may be secured by any suitable means 28.

Figure 2:
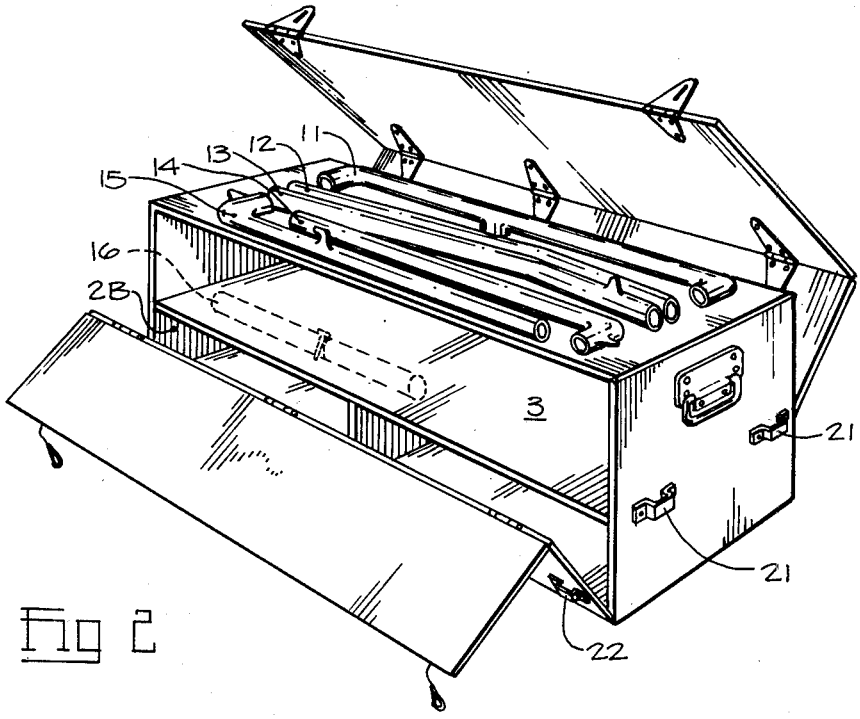
FIG. 2 shows the device partly unfolded and reveals the storage arrangement of the tubular frame support members.

FIG. 2 shows the box in a partly unfolded condition and illustrates the manner in which the tubular frame members are presented for easy removal. Suitable perforations are provided in the top of the box to accommodate any projections or right angled bends of the tubular frame members. If wheeled transport is necessary telescopic leg 16 is slid through a hold in end wall 2B to serve as a pull handle with a retaining pin used to prevent its complete removal.

Figure 3:
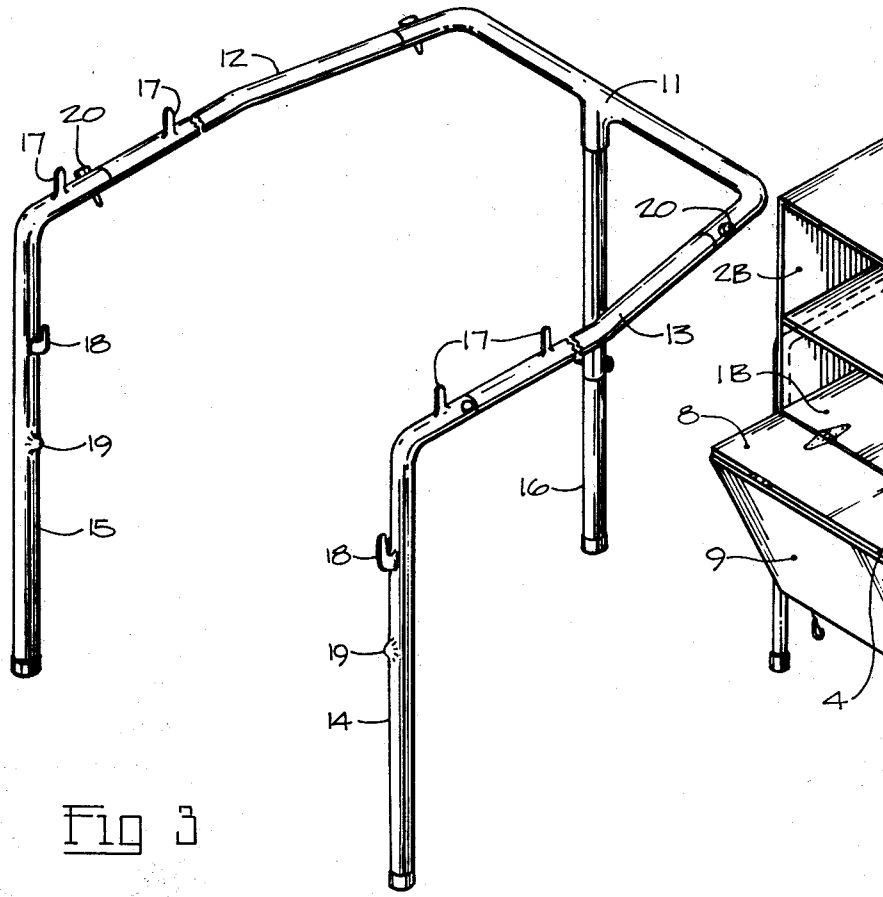
FIG. 3 shows the tubular members coupled together to provide an elevated support means for the box-table combination.

FIG. 3 shows the tubular frame members in a set-up condition with their telescopic interfitting ends coupled together and held securely by pin fasteners 20. The upper section of telescopic leg 16 fits into frame member 11. Flat lugs 17 are designed to engage brackets 21. (Brackets shown in FIG. 2). A pair of brackets are provided on both end faces of box 10. To enhance rigidity of the device cylindrical shaped projections 18 engage in holes provided in the bottom of the box. Stops 19 support the bottom edge of leaf 9 (shown in FIG. 4).

The lugs and stops may be welded, or fastened by other means, to the frame members.

Figure 4:
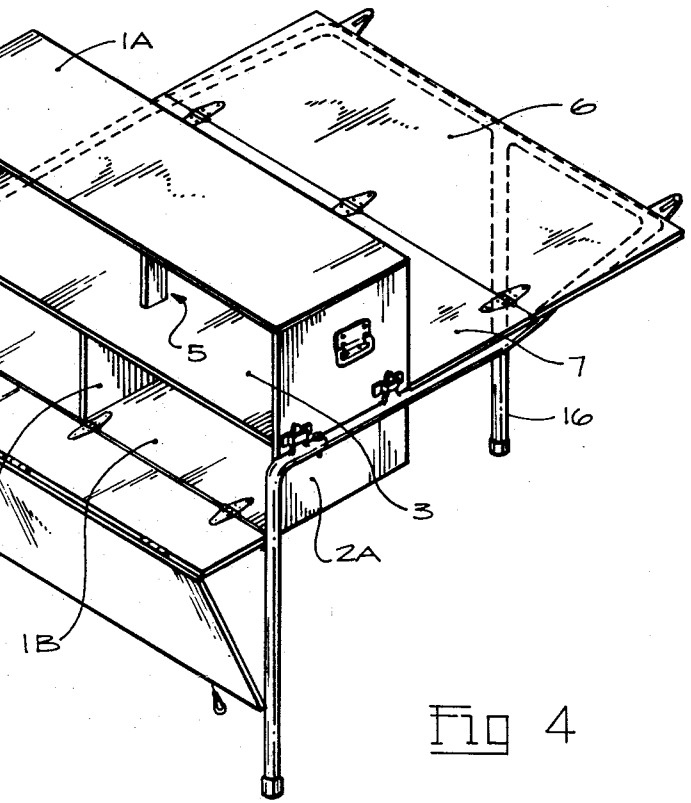
FIG. 4 is a perspective view of the device in its fully unfolded position and ready for use.

FIG. 4 shows the box fully unfolded and mounted in an elevated position on the tubular framing. Broken lines illustrate the manner in which the angled side frame members provide an undersupport means for the extremity of leaf 7 and fully support leaf 6. The interior of the box is compartmented by horizontal partition member 3 and vertical partition member 4. A post-like member 5 provides additional rigidity and eliminates flexure of the box top 1A as well as serving as a means to which various contents may be secured.

Figure 5:
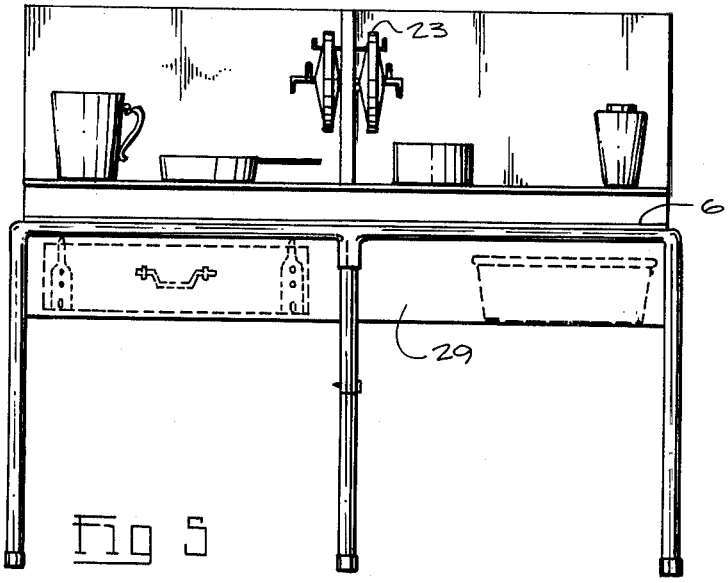
FIG. 5 is a front elevation indicating the manner and arrangement by which the contents may be stored.

In FIG. 5 wheels 23 are suspended from hook-like supports. An edge view of the extremity of leaf 6 is seen and below leg 6 in broken lines are shown a gas stove and wash basin obscured from view by a rigidfying narrow wall panel 29. The smaller utensils may be placed in the wash basin and the larger utensils fastened to the walls of the box by means of straps or bands.

Figure 6:
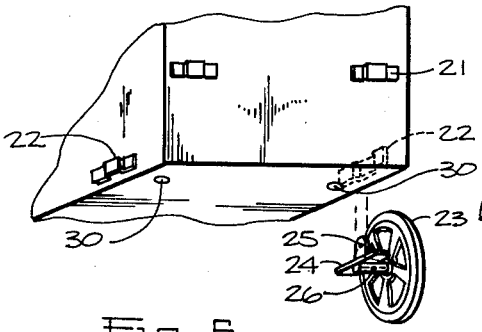
FIG. 6 shows a cut-away portion of the end of the camper box and one of a pair of stub-axle wheels for mounting on the box.

In FIG. 6, wheel 23 has a stub axle 26 with a right angled plate 24 welded or clamped thereto. The vertical wing of the right angled plate 24 has a flat lug extension 25 which fits into bracket 22 shown in broken lines on the side of the box. The right angled plate 24 fits against the bottom edge of the box. The end of stub axle 26 is inserted into eye 30 suitably located on the bottom of the box, or stub axle 26 may be provided with a cylindrical projection (not shown) perpendicular to the axle axis for engagement in a socket hole in the box bottom.

Figure 7:
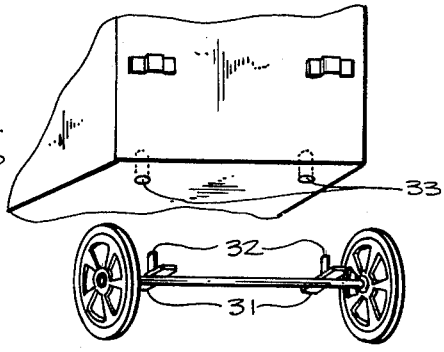
FIG. 7 shows a cut-away portion of the end of the camper box with an alternative embodiment of the wheel mounting means.

In FIG. 7, an alternative embodiment of the wheel support means comprises a set of wheels joined by an axle. On the axle are welded or clamped two flat plates which have cylindrical projections 32 which are designed to fit into socket holes 33 in the bottom of the box.

Figure 8:
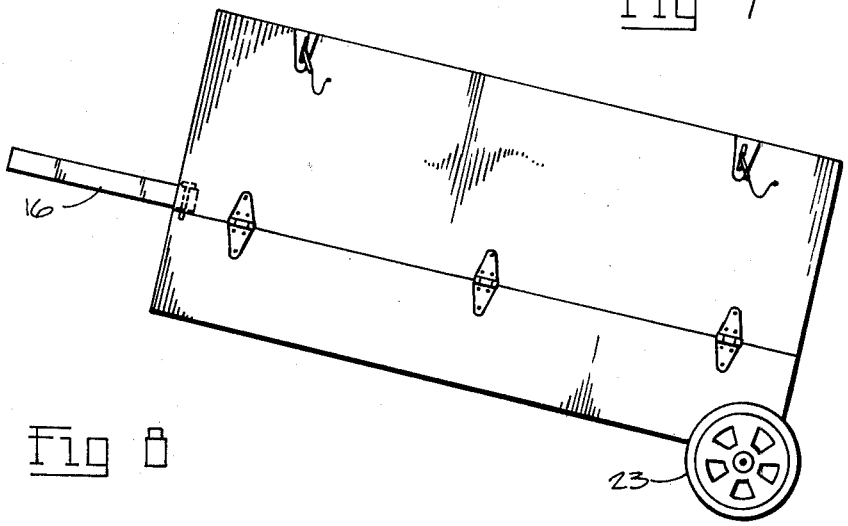
FIG. 8 is a side elevation showing the telescopic leg member serving as a pull handle for wheeled transport of the box.

FIG. 8 shows the box-table combination in a transport mode with telescopic leg 16 being utilized as a pull handle and wheels 23 providing a traveling ground support means. The provision of wheeled support means may prove advantageous when it is necessary that the device be moved a considerable distance by one person.

I believe that the drawings and the foregoing description are sufficiently detailed to make it possible to construct and practise the present invention. My particular camper box-table combination has a length of approximately 3 feet, a width of 13 inches and an overall height of 16 inches when it is folded up for storage or transport. I find this size most suitable for manually handling the device or loading it on a roof carrier or into the trunk of most vehicles. Modifications in its size or general characteristics should not depart from the scope of the invention herein disclosed and defined by the appended claims.

The embodiments of the invention in which an exclusive property or privilege is claimed are defined as follows:

1. A compact, portable, compartmented box-table combination which provides storage space for equipment necessary for the preparation and serving of meals, comprising an open-sided box having a top panel and a bottom panel held in spaced substantially parallel relationship by two end members, a rigifying narrow side panel fixedly mounted adjacent said bottom panel, two pairs of interhinged leaves, the first pair hingedly attached at one side of the box to the top edge of said rigifying narrow side panel and the second pair of interhinged leaves hingedly attached at the opposite side of the box to the edge of said bottom panel such that when both pairs of interhinged leaves are folded upwardly they serve as side walls for the box and also provide an enclosed space above said top panel for the storage of support frame components.

2. A camper box as defined in claim 1, said support frame components consisting of telescopically interfitting tubular members which can be coupled together to form a three-legged support means for said camper box.

3. A camper box as defined in claim 2, wherein one of three leg members comprises an upper tubular section and a lower tubular section which is telescopically adjustable within the upper section.

4. A camper box as defined in claim 3, further including a pair of wheels removably attached at one end of said bottom panel and said telescopic leg member protruding from the end member remote from the wheels and serving as a pull handle.

* * * * *